US005264999A

United States Patent [19]

Kempter

[11] Patent Number: 5,264,999

[45] Date of Patent: Nov. 23, 1993

[54] LIGHT SCREEN

[75] Inventor: Georg Kempter, Bregenz, Austria

[73] Assignee: Zumtobel AG, Dornbirn, Austria

[21] Appl. No.: 687,885

[22] PCT Filed: Sep. 13, 1990

[86] PCT No.: PCT/EP90/01551

§ 371 Date: Jun. 3, 1991

§ 102(e) Date: Jun. 3, 1991

[87] PCT Pub. No.: WO91/05203

PCT Pub. Date: Apr. 18, 1991

[30] Foreign Application Priority Data

Oct. 3, 1989 [DE] Fed. Rep. of Germany ..... 3932935

[51] Int. Cl.[5] ..... F21V 11/02

[52] U.S. Cl. ..... 362/342; 362/347

[58] Field of Search ..... 362/342, 346, 347, 349

[56] References Cited

U.S. PATENT DOCUMENTS 4,268,897 5/1981 Schierwagen et al. ..... 362/290
4,888,668 12/1989 Roll ..... 362/342
5,029,059 7/1991 Grimm ..... 362/290

FOREIGN PATENT DOCUMENTS 268986 6/1988 European Pat. Off. .
2833010 4/1980 Fed. Rep. of Germany .
3005762 10/1981 Fed. Rep. of Germany .
82301077 2/1983 Fed. Rep. of Germany .
3239692 5/1984 Fed. Rep. of Germany .
85087408 6/1985 Fed. Rep. of Germany .
3437192 4/1986 Fed. Rep. of Germany .
88112497 12/1988 Fed. Rep. of Germany .

*Primary Examiner*—Richard R. Cole
*Assistant Examiner*—L. Heyman
*Attorney, Agent, or Firm*—Brown, Martin, Haller & McClain

[57] ABSTRACT

Described is a light screen with curved outside reflectors and perpendicular cross lamellas with roughly V-shaped cross-section, each of which is inserted into the outside reflectors through corresponding cut-outs, whereby the walls of the cross lamella feature bracket edges on the top which are arranged on the inside of the outer reflectors. In order to attach the cross lamella to an outside reflector by machine in a simple manner, a straight lip on the bottom of the cross lamella is designed as a bracket edge and can be driven into the outside reflector, ana the walls of the cross lamella feature outward breaks which penetrate the cut-out in the outside reflector and when locked rest against the outside of the outside reflector.

8 Claims, 3 Drawing Sheets

LIGHT SCREEN

The invention concerns a light screen with curved outside reflectors and perpendicular cross lamellas with roughly V-shaped cross-section, each of which is inserted into the outside reflectors through corresponding cut-outs, whereby the walls of the cross lamella feature bracket edges on the top which are arranged on the inside of the outside reflectors.

Such a light screen is already known from DE 30 05 762 C2. In this known light screen the cross lamella features a cross slot whereby for the purpose of attaching the cross lamella to the outside reflector the bottom of each cut-out of the outside reflectors is inserted into a cross slot of a cross lamella.

As a result, in this light screen the cross lamella had to be suspended in the outside reflector in the form of a circular motion in order to mount both parts in the right position, i.e. to bring the cross lamella into the outside reflector for locking. To this effect, the cross slot of the cross lamella was first introduced into the cut-out of the outside reflector and then the cross lamella was rotated with a circular motion onto the outside reflector whereby the outside reflector featured projections which locked in locking slot at the cross lamella.

As a result, mounting of the cross lamella to the corresponding outside reflectors could only be done at great effort, and could not be done by machine.

Task of the present invention is to effect an attachment between a cross lamella and an outside reflector of a light screen which can be done by machine and in a simple manner.

According to the present invention, a light screen is provided which comprises a pair of spaced outer reflectors and a plurality of cross lamellas extending transversely between the outer reflectors. The outer reflectors have aligned pairs of openings and the lamellas have projecting ends which are designed to project through the aligned openings at opposite ends of each lamella. Each lamella is of V-shaped cross-section and the openings in the reflectors are of substantially matching V-shape. Each lamella comprises a pair of flaps joined together at the lower end of the lamella to form the V-shape. The flaps are cut away at their upper and lower edges at opposite ends of each lamella to form a stepped region for bearing against the inner surface of the respective reflector when the projecting ends extend through the respective openings. The projecting ends of each flap include an outward projection for resting against the outer surface of the reflector when the projecting ends extend through the openings, and an inwardly bent portion forming a wedge-shaped surface at the outermost end of the lamella.

This new type of attachment makes it possible for the very first time to drive the cross lamella in the direction of its longitudinal axis straight into the cut-out of the perpendicular outside reflector thus effecting a self-activated locking of the cross lamella in the cut-out of the outside reflector. A swinging motion as required by the known light screens for driving the cross lamella is no longer necessary in accordance with the invention. As a result, a simple mounting of such cross lamellas by machine in outside reflectors is now possible.

The making of the outward projections is particularly simple. It is also very simple to punch out the stepped regions thus producing an inexpensive slide-in part without cumbersome deformation. An outward projection or ridge can be made by chamfering the material of the cross lamella and forming an outwardly deformed edge protruding from the plane of the cross lamella. It is also possible to make such a by forming a crease.

In the preferred embodiment the front-side edges of the cross lamella are bent inwardly to form wedge-like surfaces which are tapered and preferably curved at their outermost edges, the surfaces facing outwardly in the longitudinal direction of the cross lamella.

Bending of the front-side edges of the cross lamella can be accomplished in a simple manner resulting in a simple centric drive into the cut-out of the outer reflector in connection with the conic wedge surfaces.

In another preferred embodiment, the lip features slanted edges in the direction of entry which on the one hand correspond to the outer contours of the outside reflector, on the other are oriented perpendicular to the cross-section of the outside reflector. As a result, the lip lies form-closed against one side of the outside reflector.

As a result, entry edges are created in the area of the lip which upon entry secure the cross lamella to the bottom in the area of the cut-out of the outside reflector.

The following is a more detailed description of the invention through drawings which illustrate only one variant. The drawings and their descriptions disclose further features and advantages which are essential to the invention.

The object of this invention comprises not only the object of the individual patent claims but also the combination of individual patent claims among one another. All data and characteristics disclosed in the documentation —including the summary, in particular the set-up and design as illustrated in the drawings are claimed as integral part of the invention to the extent that they are new, severally or jointly, in terms of the state of the art.

Figure 1:
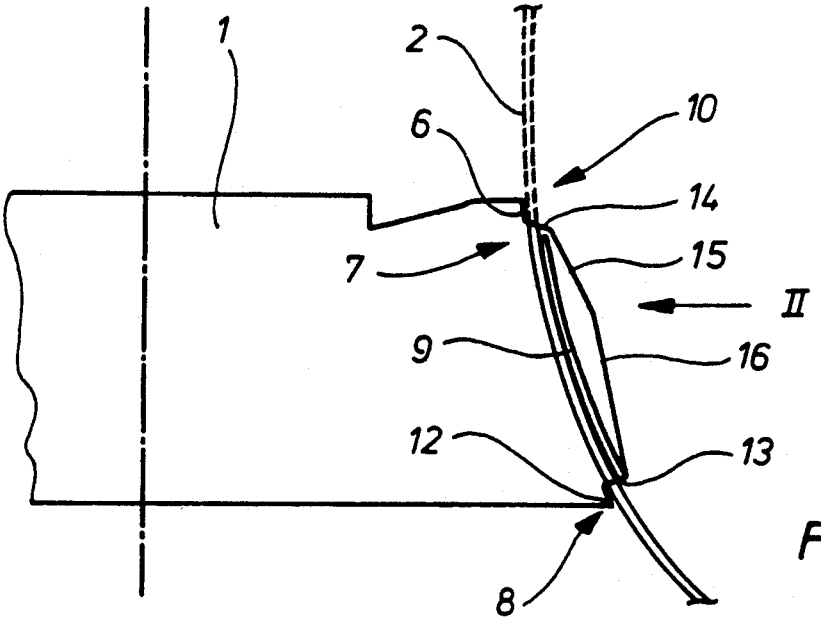
FIG. 1 shows a lateral view of a cross lamella in slide-in position in a cut-out of the outside reflector.
Figure 3:
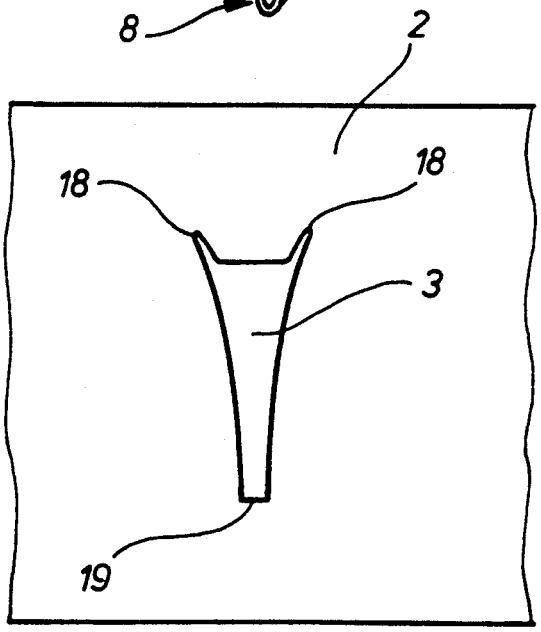
FIG. 3 shows a partial view of an outside reflector with a cut-out for sliding in the cross lamella.

FIG. 1 shows an outside reflector 2 with a cut-out 3 in accordance with FIG. 3, into which a cross lamella 1 has been introduced.

Figure 2:
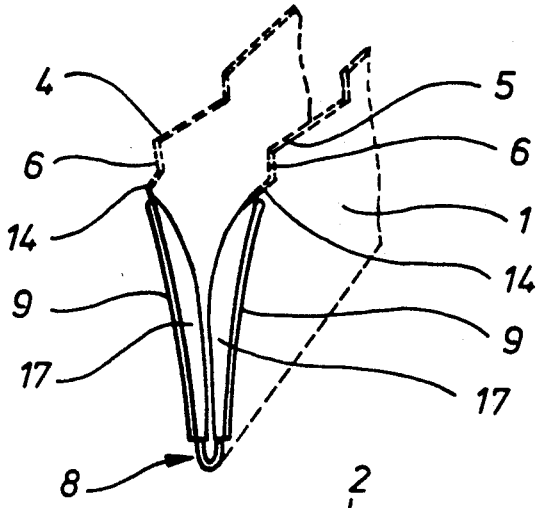
FIG. 2 shows a front view of the cross lamella in accordance with FIG. 1 in part in perspective in the direction of the arrow II.
Figure 4:
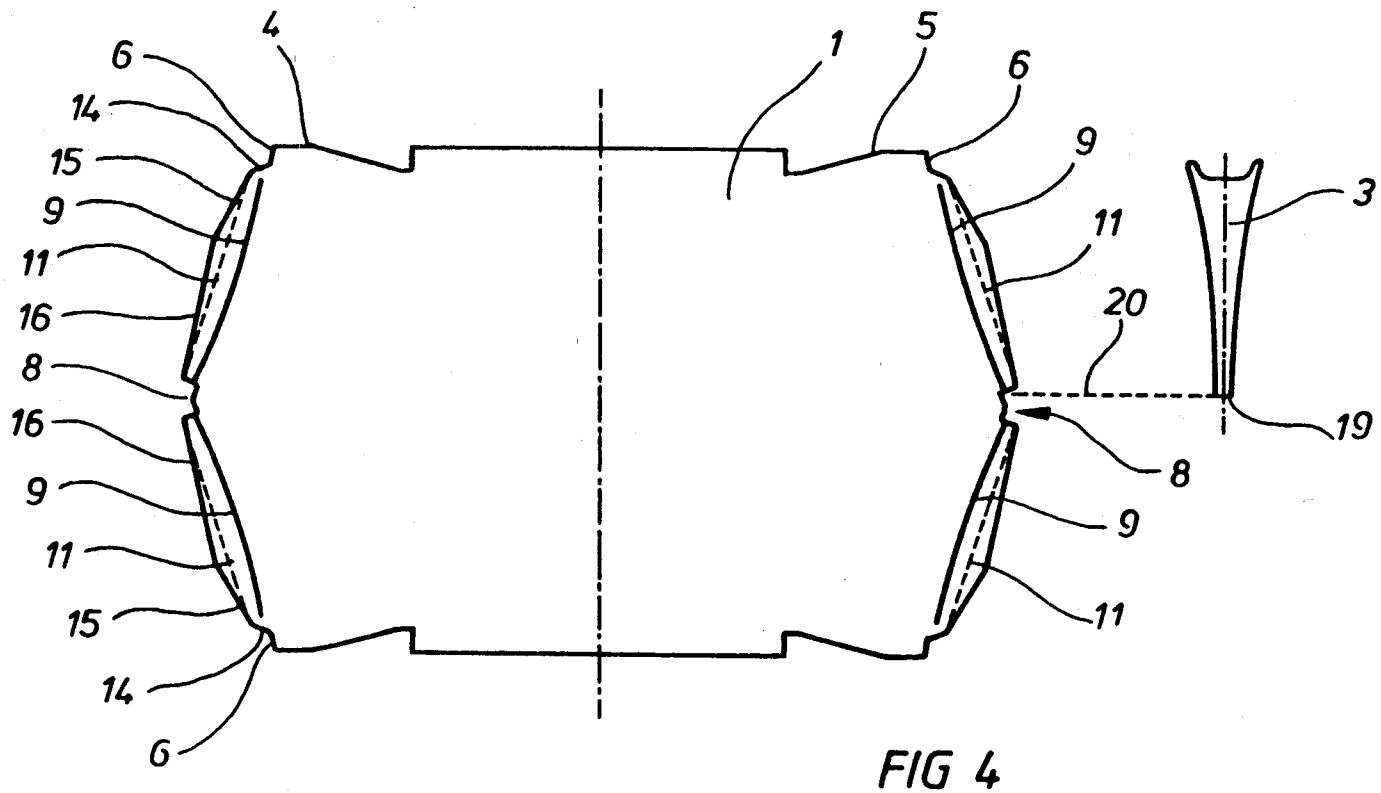
FIG. 4 shows the cross lamella as rolled out with stretched outer contour.
Figure 5:
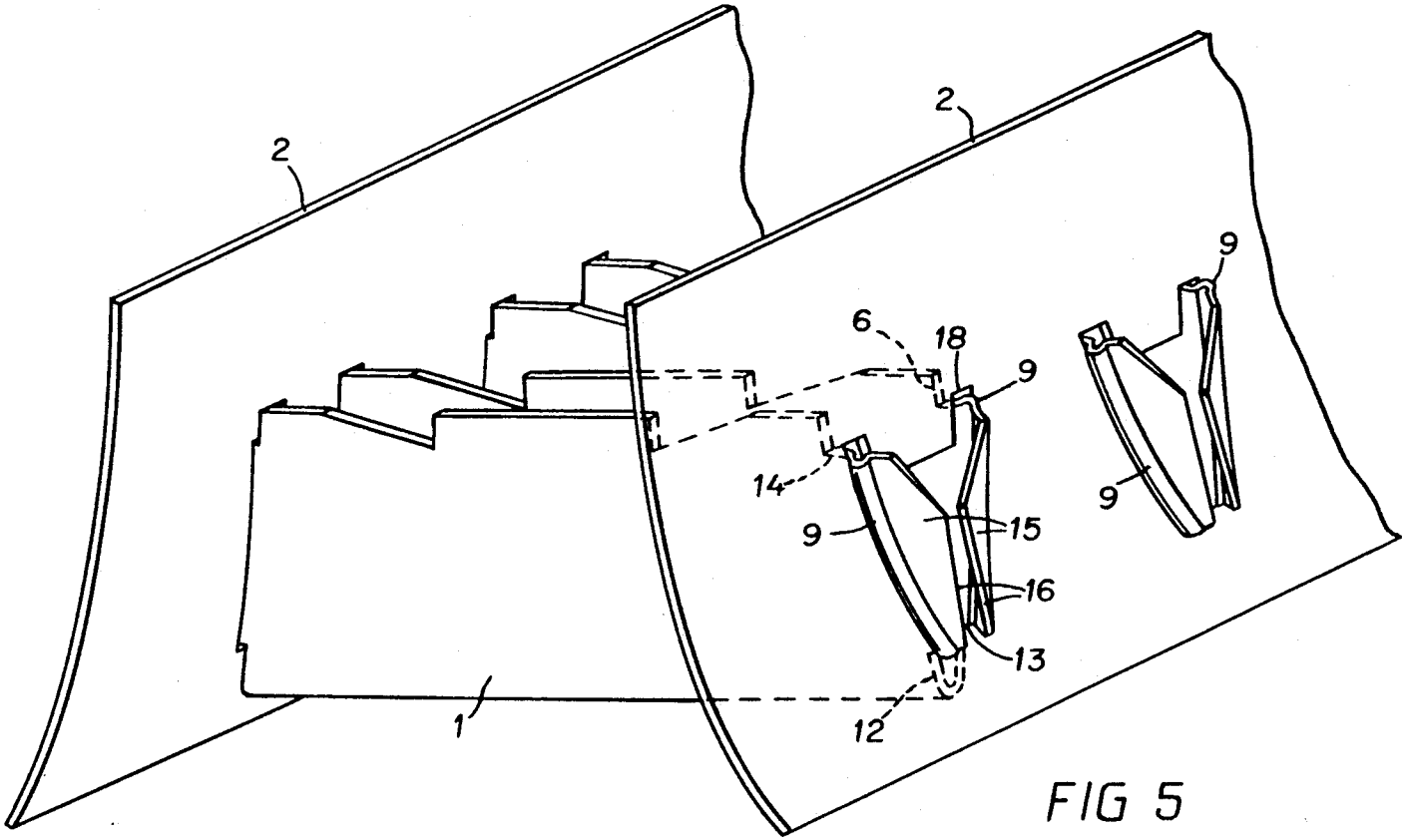
FIG. 5 is a perspective view of the light screen illustrating a pair of outside reflectors with two perpendicular cross lamellae extending between the reflectors.

FIG. 5 illustrates a pair of cross lamellas 1 extending between outside reflectors 2 on opposite sides, the opposite ends of each cross lamella extending through aligned openings or cut-outs 3 in the opposite reflectors 2. As illustrated in FIGS. 1 and 2, each cross lamella is of generally V-shaped cross-section comprising a pair of flaps or walls 4, 5 connected together along fold or bending line 20 (see FIG. 4).

Each flap 4, 5 has an indented or stepped region 8 at its bottom edge at the opposite ends of the lamella, and a similar indented or stepped region 6 at the upper edge of the flap, forming a projecting end portion of reduced height for projecting through cut-out 3, as illustrated in FIG. 1. Each flap 4, 5 has an outward projection or rib 9 on its outer surface in each of the projecting end portions, as illustrated in FIGS. 1, 2 and 4. Projections or ribs 9 are designed to rest against the outside surface 10 of the side reflectors 2 when the end portions project out through openings 3, as illustrated in FIG. 1. At the same time, the stepped portions 6 and 8 lie against the inside surface 7 of the outside reflector 2.

Stepped portion 8 is formed as illustrated in FIG. 4. Portion 8 has slanted edges 12, 13. Bearing edge 12 is slanted to conform to the shape of the inner contour of reflector 2 adjacent the lower end 19 of the cut-out 3, as best illustrated in FIG. 1. Edge 12 is oriented particular to the cross-section of reflector 2. Stepped portion 6 is also formed with slanted edges, the edge 14 being slanted downwardly to form a run-in slope for guiding the projecting end of the lamella through the opening 3. Thus, upper and lower edges 14, 12 act as lead-in edges to allow the projecting end portion of each flap to be driven straight into the opening.

When mounting the cross lamella 1 in the area of the cut-out 3 of the outside reflector 2 the edge 12 of stepped portion 8 drives in a straight direction on the bottom 19 of the cut-out 3 in accordance with FIG. 3, while the upright edge of stepped portion 6 comes to rest on the inside 7 of the outside reflector 2.

FIG. 4 shows projections 9 which are made preferably through chamfering of the material, whereby a V-shaped cross-section of the cross lamella is created by bending along the bending line 20 in accordance with FIG. 4 with lateral projections 9 directed outward over the surfaces of the walls 4, 5.

FIG. 4 illustrates a lamella in a flat sheet condition prior to bending and folding into the condition illustrated in FIGS. 1, 2 and 5. The ends of each flap are bent inwardly along line 11 to form wedge-like surfaces 17 in accordance with FIG. 2. Through these wedge surfaces 17 the cross lamella 1 is easily introduced into the cut-out 3 in accordance with FIG. 3 whereby the projections or protuberances 9 penetrate the cut-out 3 and then rest locked on the outside 10 of the outside reflector 2 in accordance with FIG. 1. This design guarantees a linear contour-true arrangement of the cross lamella 1 on the outside reflector 2.

The bracket edge 6 and the lip 8 hold the cross lamella on the inside 7 of the outside reflector 2 in the opposite direction to projections.

FIG. 1 shows that in connection with the wedge surfaces 17 in accordance with FIG. 2 the edge 13 and the feed slant 14 facilitate the drive of the cross lamella 1 into the cut-out 3.

The front edges of each flap of the cross lamella include bevel 15 and sloped edge 16, whereby the cross lamella is readily introduced into the cut-out 3 even if the cross lamella has been inadvertently placed slanted on the cut-out.

FIG. 1 shows in connection with FIG. 2 that, in order to facilitate the introduction of the cross lamella into the cut-out 3 and in order to secure the cross lamella, wedge surfaces 17 are tapered inward with a curvature and have bevel 16 as well as sloped edge 15. This shape in addition to the run-in slope 14 and slanted run-in edge 13 allows the cross lamella to easily be introduced into the cut-out 3 with a simple slide-in motion without further rotation.

FIG. 3 shows that the upper side of the cut-out 3 features guides 18 in order to reach a certain centering on the walls 4,5 of the cross lamella 1 in connection with the stepped or indented region 6.

I claim:

1. A light screen, comprising:

a pair of spaced, curved outside reflectors, the reflectors having inside and outside surfaces and pairs of aligned openings, the surfaces having a curved contour;

a plurality of cross lamellas extending transversely between the reflectors, each lamella having an upper edge, a lower edge, and opposite outermost end edges and being of substantially V-shaped cross section comprising a pair of inclined flaps interconnected along the lower edge of the lamella, each said flap having an outer face, a central portion and projecting opposite outer end portions extending from said central portion up to said outermost end edges, said opposite outer end portions extending through respective said pairs of aligned openings in the outside reflectors, each of said aligned openings having an upper edge, a lower edge, and outwardly-tapering side edges having an inclination substantially matching that of the lamella side flaps;

each said flap having a step formation at the lower edge of the lamella between each said outer end portion and the central portion of the flap, the step formation having a first edge extending substantially transverse to the lower edge of the lamella, the first edge having a shape corresponding to the contour of the inside surface of each said reflector adjacent the lower edge of each of said aligned openings and comprising means for resting against the inside surface of a respective said reflector as the projecting outer end portion extends through a respective one of said aligned openings, and a second, straight edge extending perpendicular to the lower edge of said one opening and out to the outermost end edge of said lamella, said second, straight edge comprising means for inserting straight through said respective opening and resting on the lower edge of the said respective opening;

each said flap having an outward projection in said outer face on said outer end portion for resting against the outside surface of the respective reflector when the outer end portions project through said aligned openings; and each said outer end portion including an inwardly bent portion forming an outwardly facing wedge surface at the outermost end edges of the cross lamellas.

2. A light screen, comprising:

a pair of spaced, curved outside reflectors, the reflectors having inside and outside surfaces of predetermined contour and pairs of aligned openings of predetermined height;

a plurality of cross lamellas extending transversely between the reflectors, each lamella being of substantially V-shaped cross-section comprising a pair of flaps, each said flap having an upper edge, a lower edge, and outermost end edges and said flaps being interconnected along the lower edges of the flaps, each flap having a central portion and a projecting end portion of reduced height relative to the central portion at opposite ends of the lamella, each said projecting end portion comprising means for extending through a respective one of a pair of said aligned openings in said reflectors, each said projecting end portion having an outer surface and an outward projection on said outer surface comprising means for resting against the outside surface of the respective reflector when the projecting end portions of each said flap project through a respective said pair of aligned openings in said respective reflectors; and the projecting end portions of each said flap having a maximum height less than the height of said openings and straight upper and lower lead-in edges comprising means for allowing each said projecting end portions to be driven straight into a respective aligned reflector openings without rotation.

3. The screen as claimed in claim 2, wherein each end portion has an outer end edge comprising a curved and inwardly tapered wedge surface.

4. The screen as claimed in claim 3, wherein each said aligned opening has an outer perimeter of shape substantially matching that of the lamella cross-section, said outer perimeter having an upper end, a lower end and outwardly-slanted side edges extending between the lower and upper end.

5. The screen as claimed in claim 4, wherein each said aligned opening has guide slits at said upper end projecting upwardly from each side edge for receiving the upper lead-in edges of the projecting end portions of each flap to guide the end portions through the opening.

6. The screen as claimed in claim 4, wherein each said flap has an indented upper step in its upper edge and an indented lower step in its lower edge between each projecting end portion and the central portion of the flap, each upper step having an upper bearing edge extending substantially transverse to the upper edge of the flap and each lower step having a lower bearing edge extending substantially transverse to the lower edge of the flap, the upper and lower bearing edges comprising means for bearing against the inside surface of a respective reflector when the end portion projects outwardly through a respective one of said aligned openings in said respective reflector.

7. The screen as claimed in claim 6, wherein the upper and lower bearing edges are shaped to correspond to the contour of the inside surface of the reflector adjacent the upper and lower ends of the respective aligned opening, respectively.

8. The screen as claimed in claim 2, wherein each outward projection comprises an elongate rib extending along substantially the entire height of the respective end portions and having a shape corresponding to the contour of the outside reflector.

* * * * *